United States Patent [19]

Mendez

[11] Patent Number: 4,738,068

[45] Date of Patent: Apr. 19, 1988

[54] ROOF TILE WITH CHANNEL

[76] Inventor: Fernando Mendez, 10370 NW. 135 St., Hialeah Gardens, Fla. 33016

[21] Appl. No.: 2,517

[22] Filed: Jan. 12, 1987

Related U.S. Application Data

[63] Continuation-in-part of Ser. No. 866,835, May 27, 1986, Pat. No. 4,651,492, which is a continuation-in-part of Ser. No. 754,608, Aug. 19, 1986, Pat. No. 4,606,164.

[51] Int. Cl.[4] ..... E04D 1/04

[52] U.S. Cl. ..... 52/536; 52/588; 52/595

[58] Field of Search ..... 52/533, 536, 539, 588, 52/595

[56] References Cited

U.S. PATENT DOCUMENTS

| | | | |
|---|---|---|---|
| 3,434,260 | 3/1969 | Carter | 52/542 |
| 4,606,164 | 8/1986 | Mendez | 52/536 |
| 4,651,492 | 3/1987 | Mendez | 52/536 |

*Primary Examiner*—J. Karl Bell

*Attorney, Agent, or Firm*—Jesus Sanchelima

[57] ABSTRACT

A roof tile that has a top upper rectangular flat member and a wedged honeycomb frame integrally built on its underside. Grooves are formed on the underside of the top rectangular member and substantially adjacent to the lateral sides of the top rectangular flat member. The front and rear wall of the wedged from structure extend diagonally downwardly from the underside of the top member and towards the front of the tile. A cooperating gutter member is positioned below the interface of horizontally abutting tiles to collect the water that goes through the interface opening and to discharge it over the vertically abutting roof tile in front.

4 Claims, 3 Drawing Sheets

ROOF TILE WITH CHANNEL

OTHER RELATED APPLICATIONS

The present application is a continuation-in-part of U.S. patent application Ser. No. 866,835, filed on May 27, 1986 now U.S. Pat. No. 4,651,492, now allowed, which in turn is a continuation-in-part application of Ser. No. 754,608 filed on Aug. 19, 1960 now U.S. Pat. No. 4,606,164.

BACKGROUND OF THE INVENTION

1. Field of the Invention

The present invention relates to roof tiles, and more particularly, to roof tiles having a honeycomb wedge base member.

2. Description of the Related Art

The tiles disclosed and claimed in the parent application mentioned above failed to pass environmental tests relating to the strength of its affixation to the roof. Many jurisdictions in the U.S. and the World require that roof tiles withstand a predetermined amount of wind force that is simulated in a wind tunnel. The roof tile in the above referenced pending application had marginal characteristics.

Applicant believes that the closest reference corresponds to U.S. Pat. No. 4,606,164 issued to inventor herein on Aug. 19, 1986. However, it differs from the present invention because it does not provide for a sufficiently strong interlocking engagement between longitudinally disposed adjoining tiles that would prevent the lifting of the tiles by the action of hurricanes or any other phenomena.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a volumetrically efficient roof tile that is capable of withstanding forces caused by hurricanes and other natural phenomena without falling off the roof structure where they are installed.

It is another object of this present invention to provide a roof tile that may be installed directly on the roof trusses of a dwelling or other building structure without requiring the conventional roof sheathing.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
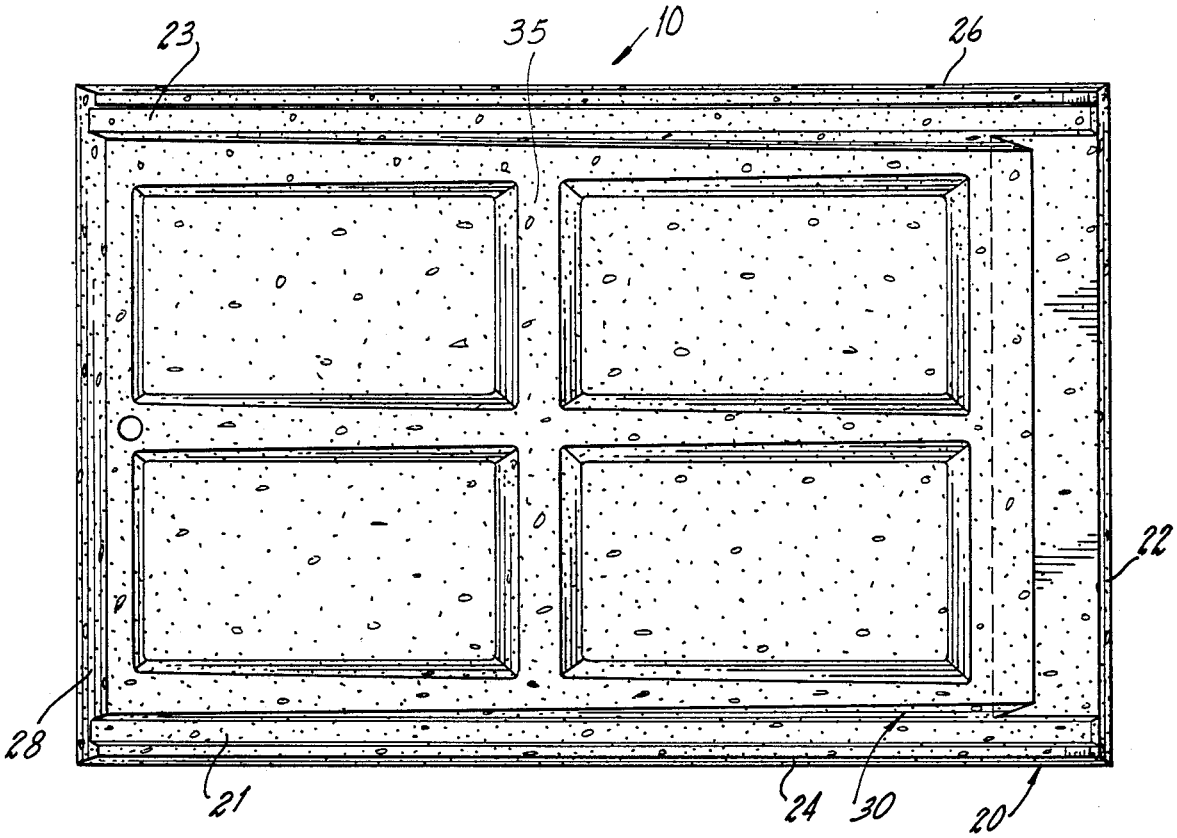
FIG. 1 represents a bottom view of a preferred embodiment.
Figure 2:
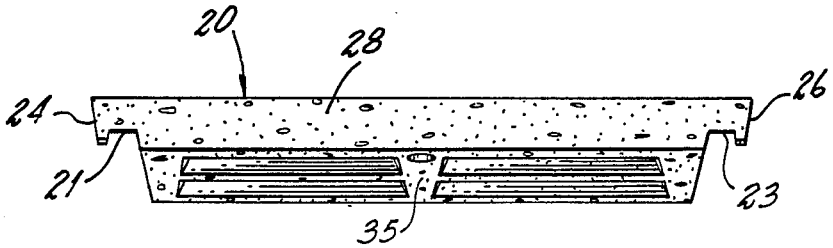
FIG. 2 shows a rear elevational view of the present invention.

Referring now to FIG. 1, it can be seen that the present invention is generally referred to with numeral 10. As in the parent applications, the roof tile has substantially a flat rectangular shape and it is basically composed of upper or top rectangular member 20 and wedge frame 30 integrally built on the underside of member 20. Upper rectangular member 20 has front wall 22, right wall 24, left wall 26 and rear wall 28. Longitudinal grooves 21 and 23 extend close to left right walls 24 and 26, as shown in FIGS. 1 and 2.

Figure 8:
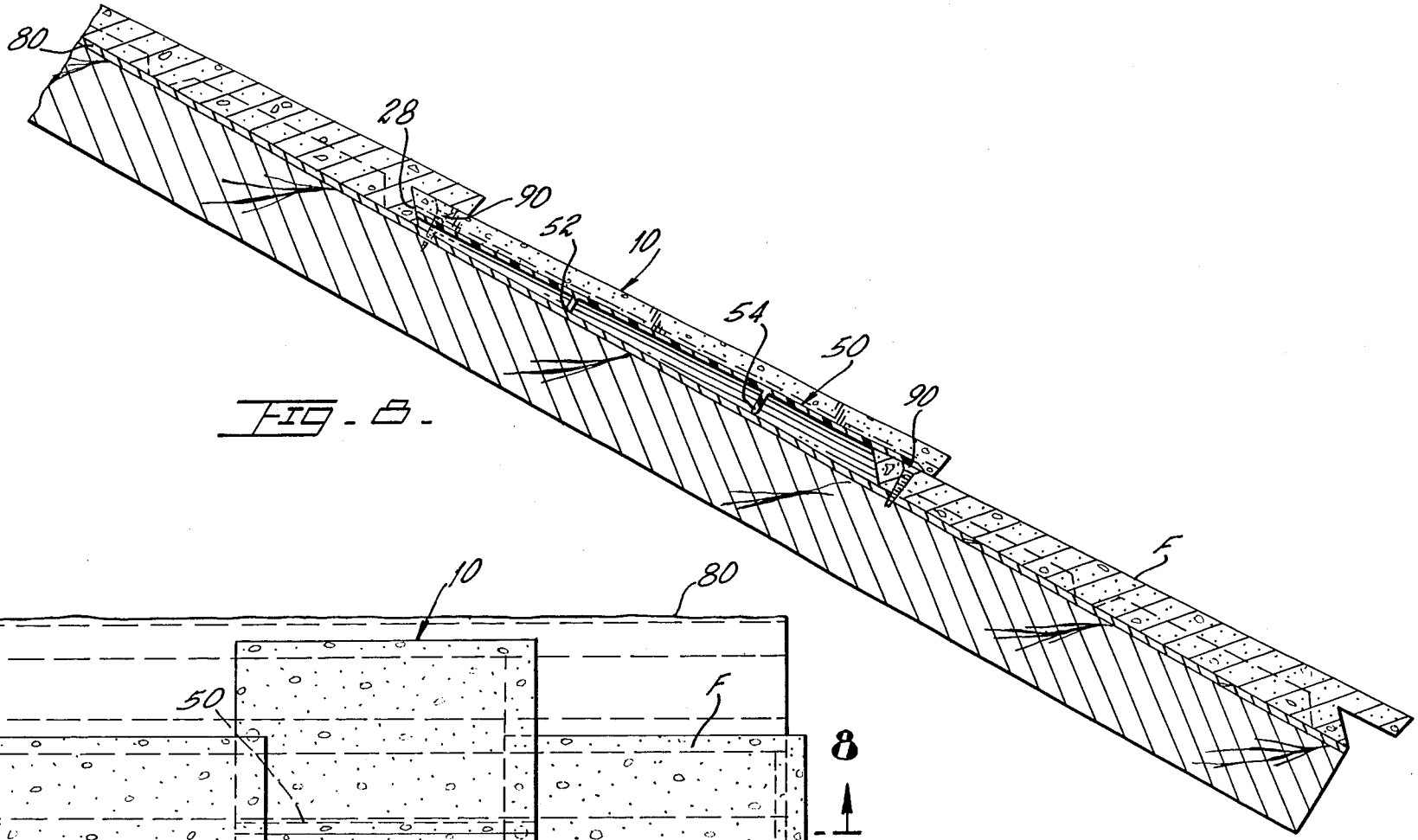
FIG. 8 is a cross-sectional representation of an elevational side view of vertically or longitudinally adjoining roof tiles taken along line 8—8 in FIG. 7.

As in the parent application, frame member 30 has a honeycomb appearance that is intended to keep the cost and weight of the tile low while providing the necessary strength. The uniform and flat lower surface 35 of frame member 30 provides an adequate resting area that comes in contact with roof sheathing 80, as seen in FIG. 8.

Figure 3:
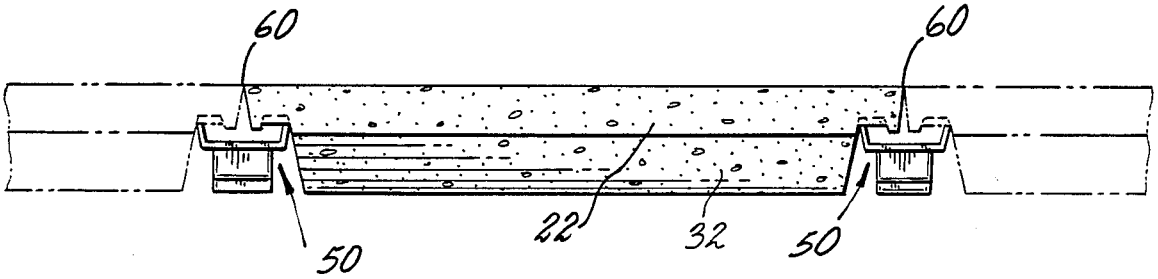
FIG. 3 illustrates the interlocking engagement of horizontally or transversally abutting roof tiles and the position of the water collecting trough or channel.

In FIG. 3, one of the tiles 10 is shown, from the front, with horizontally abutting roof tiles (in phantom) on its sides showing a gutter, channel or trough member 50 positioned below the interface openings 60 defined by horizontally abutting tiles. The water that goes through openings 60 is collected by gutter member 50 and discharged over the vertically abutting tile front, F in FIG. 8.

Figure 4:
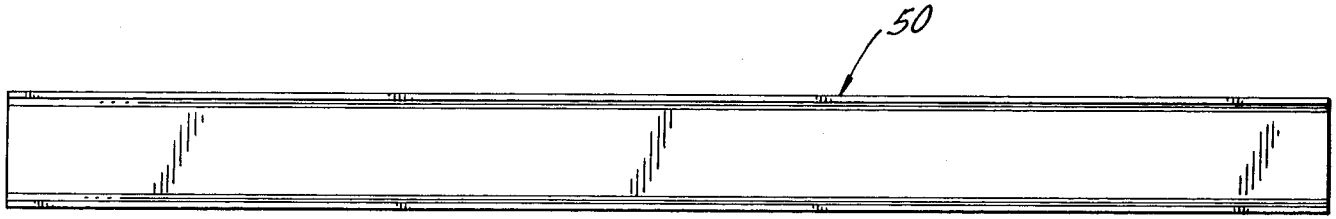
FIG. 4 is a top view of the channel member.
Figure 5:
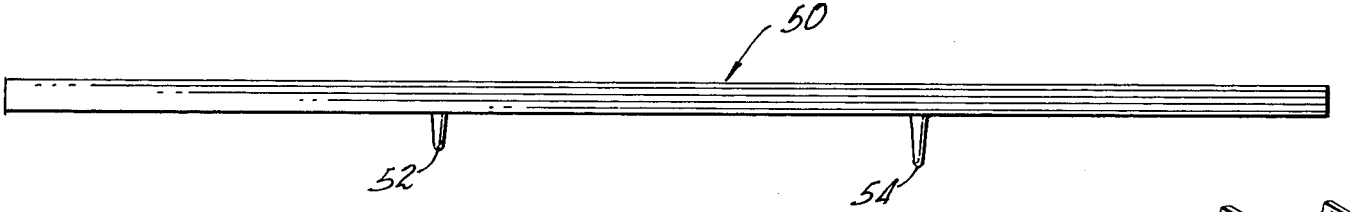
FIG. 5 is an elevational side view of the channel member.
Figure 6:
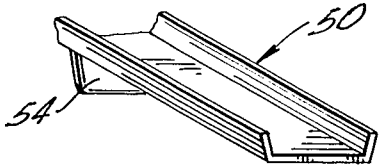
FIG. 6 is a partial view in perspective of the channel member.

Gutter member 50, as in more clearly seen in FIGS. 4, 5 and 6, has the shape of a channel or trough with two leg supports 52 and 54. Leg support 52 is shorter than leg support 54 so that it compensates for the roof pitch or inclination.

Figure 7:
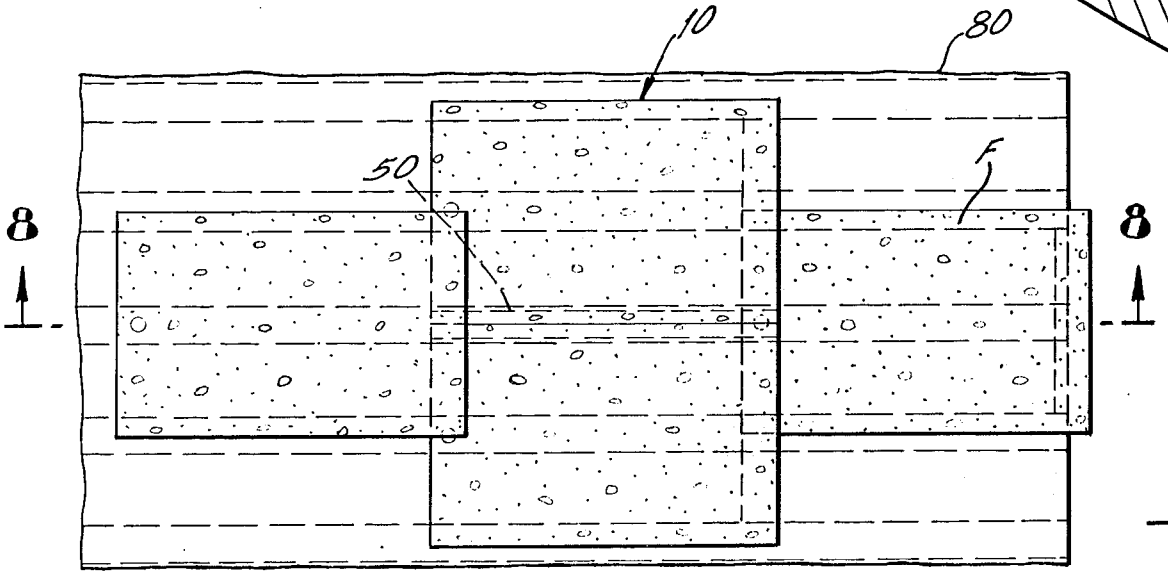
FIG. 7 is a top view of installed roof tiles.

In contrast with the roof tile disclosed in the parent application, the present invention has an inclined front wall 32 of wedge member 30 and an inclined rear wall 28 that extends downwardly to the wedge member 30 area below. The interlocking of vertically disposed tiles can be observed in FIG. 8. As screw 90 may be used to rigidly keep tile 10 in place with respect to the tile in front F. The significance of this interlocking is that it maintains all vertically disposed tiles, and since they overlap horizontally, and all tiles in general rigidly mounted in place. This in necessary in order to withstand the elements, including hurricanes. In FIG. 7, it can be observed that a higher vertically abutting pair of tiles partially interlock with the vertically abutting tile F in front. Therefore, all tiles are interlock among themselves.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A roof tile to be contiguously arranged in horizontal or vertical rows, comprising:

A. a substantially rectangular top member having an upper, an underside, front, rear, left and right walls, and including parallel to a substantially close to said right and left walls two longitudinally extending grooves formed on said underside;

B. a substantially rectangular frame member attached to the underside of said top member having longitudinal and lateral reinforcement members within said frame member and defining at least four cavities, said frame structure being adjacent to said rear wall and having a smaller longitudinal length and width than said top member and said frame structure further including front and rear walls that extend diagonally downwardly and towards the front of the tile so that an interlocking cavity is formed with the front portion of the underside of said top member and said frame member thereby allowing the housing of a portion of the rear part of a longitudinally contiguous tile within said interlocking cavity in cooperative abutting relationship with said front wall thereby eliminating any space between said front wall and said rear portion of said contiguous tile; and C. longitudinally gutter means having a flat bottom and upwardly extending side walls that cooperate with said longitudinal grooves and said sidewalls being substantially housed therein so that when said roof tile is horizontally abutting with a similar tile said gutter means is positioned below the interface opening of the tiles.

2. The roof tile set forth in claim 1 wherein said frame member has a wedge like elevational shape thereby increasing the depth of said frame member towards the front of said tile.

3. The roof tile set forth in claim 1 wherein said gutter means includes a front end and a rear end and said gutter means extends the entire length of said tile so that said front end rests on the upper surface of the top member of a vertically contiguous tile in front of said gutter means.

4. The roof tile set forth in claim 3 wherein said gutter means is made out of a plastic material.

* * * * *